US005941475A

United States Patent [19]

Gentry, Jr.

[11] Patent Number: 5,941,475

[45] Date of Patent: Aug. 24, 1999

[54] AUTOMATIC WINDING POST

[76] Inventor: William J. Gentry, Jr., 1657 Oak View Loop Rd., Yanceyville, N.C. 27379

[21] Appl. No.: 09/218,486

[22] Filed: Dec. 22, 1998

Related U.S. Application Data

[60] Provisional application No. 60/072,552, Jan. 26, 1998.

[51] Int. Cl.[6] ..... B65H 19/22

[52] U.S. Cl. ..... 242/533.8; 242/545

[58] Field of Search ..... 242/533.8, 528, 242/538, 545, 545.1, 557

[56] References Cited

U.S. PATENT DOCUMENTS

| | | | |
|---|---|---|---|
| 1,957,518 | 5/1934 | Woock | 242/538 X |
| 2,635,822 | 4/1953 | Burman, Jr. | 242/538 |
| 3,012,735 | 12/1961 | Nebout | 242/538 X |
| 3,796,389 | 3/1974 | Nishiyori et al. | 242/545 X |
| 3,921,926 | 11/1975 | Jores et al. | 242/545.1 X |
| 4,307,851 | 12/1981 | Dunaevsky et al. | 242/545.1 X |
| 4,682,929 | 7/1987 | Kataoka | 242/533.8 X |
| 5,435,501 | 7/1995 | Alexander, III et al. | 242/533.8 |
| 5,443,226 | 8/1995 | Alexander, III et al. | 242/533.8 |

FOREIGN PATENT DOCUMENTS

| | | | |
|---|---|---|---|
| 361277540 | 12/1986 | Japan | 242/545.1 |
| 2277316 | 10/1994 | United Kingdom | 242/557 |

*Primary Examiner*—Donald P. Walsh
*Assistant Examiner*—Minh-Chau Pham

[57] ABSTRACT

Self-aligning chucks are provided on a docking station that is adapted to provided rotary motion to shaft-mounted rotatable components carried on a portable truck. The chucks are self-aligning with respect to the spatial and rotary positions of the shafts of the truck-mounted components. The post also includes means for automatically positioning a portable truck with respect to the post and maintaining the portable truck at a desired position.

8 Claims, 3 Drawing Sheets

AUTOMATIC WINDING POST

This application claims the benefit under Title 35 United States Code §119(e) of U.S. Provisional Application No. 60/072,552, filed Jan. 26, 1998.

BACKGROUND OF THE INVENTION

1. Technical Field

This invention relates generally a powered post or station at which a portable truck is positioned for material take-up or supply operations, and more particularly to such a post at which the take-up or supply truck is automatically aligned with the post and the take-up or supply members on the truck are automatically aligned with drive elements on the post.

2. History of Related Art

Portable trucks are commonly used in various manufacturing operations for the take-up and subsequent transportation of sheet materials, or the delivery and supply of sheet materials to a processing station. In particular, portable trucks are used in the tire manufacturing industry to take-up sheets of rubber plies from a ply processing station, and winding the ply on a roll with a fabric separator provided from a second roll on the truck. In this application, it has heretofore been necessary to carefully position the truck with respect to a drive post which provides a drive mechanism and a brake arrangement for the respective rolls on the truck. This has required that the truck be manually positioned in appropriate relationship with the post, the wheels of the truck dogged or chocked to prevent movement, and then the shafts of each of the rolls individually aligned with drive couplings, or chucks, provided on the post. Moreover, the rolls are typically carried on square end shafts which separately engage a respective coupling on the post. Thus, the shaft of each of the rolls must be individually aligned with a socket provided in each of the drive couplings. Not only has this procedure been very labor intensive, but has sometimes resulted in injury, such as pinched fingers, muscle strain, etc., to the person connecting the portable truck to the stationery post.

The present invention is directed to overcoming the problems set forth above. It is desirable to have a post, or station, to which a portable truck can be operatively connected without any alignment effort on the part of a person delivering the hand truck to the powered post. It is also desirable to have such a post that automatically positions the portable truck at a desired position with respect to the post. Furthermore, it is desirable to have such a post that is automatically alignable with respect to roller shafts mounted on the truck and has chucks which automatically align themselves with a square-end shaft of the truck rolls.

SUMMARY OF THE INVENTION

In accordance with one aspect of the present invention, a vertically disposed automatic winding post, adapted to receive and rotatably drive a pair of vertically spaced apart rolls mounted on a portable truck, has a lower section disposed at a fixed position and an upper section that is attached to the lower section in adjustable horizontal relationship. The lower section has a first rotatable chuck mounted thereon and a first means for controlling the rotation of the first rotatable chuck. The upper section has a second rotatable chuck mounted thereon and a second means for controlling the rotation of the second rotatable chuck. The winding post also includes a third means for drawing the truck having the vertically spaced apart rolls toward the lower section and maintaining the truck in fixed relationship with the lower section.

Other features of the present invention include the upper section of the winding post being horizontally adjustable in a lateral direction with respect to a longitudinal axis of the upper roll mounted on the truck in response drawing the truck toward the lower section of the post by the third means, and inserting a shaft end of the upper roll into the second rotatable chuck.

Additional features of the automatic winding post embodying the present invention include the third means for drawing the truck toward the lower section and maintaining the truck in a fixed relationship with respect to the lower section having at least one locking arm slidably mounted on the lower section. The locking arm has a distal end adapted to engage a predefined feature of the truck and is selectively movable in a substantially horizontal direction toward and away from the lower section of the post. The third means also includes an extendable cylinder mounted on the lower section with a movable end connected to a proximal end of the locking arm. Further, the third means includes an adjustable stop mounted on the lower section of the winding post at a position whereat the stop abuts a predetermined feature of the truck when the locking arm draws the truck toward the lower section.

Further features of the present invention include first means for controlling the rotation of the first rotatable chuck being an air brake, and the second means for controlling the rotation of the second rotatable chuck being a motor operatively connected to the second chuck through a right angle gear.

Yet another feature of the winding post embodying the present invention includes the lower section having a flange mounted on an upper end and the upper section having a flange mounted on a lower end. The flange mounted on the lower end of the upper section has a pair of laterally oriented slots. A pair of biased members, such as spring-loaded bolts or the like, are mounted in the flange of the lower section and extend through respective slots in the second flange whereby the biased members maintain the flanges of the lower and upper sections in biased, laterally slidable contact with each other.

Still another feature of the present invention includes the first and second chucks each having four jaws and a respective actuating shaft which opens and closes the jaws of the respective chuck. The winding post further includes extendable cylinders attached to each of the lower and upper sections. Each of the cylinders has a movable end attached to the actuating shaft of a respective one of the first and second chucks.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF A PRESENTLY PREFERRED EXEMPLARY EMBODIMENT

Figure 1:
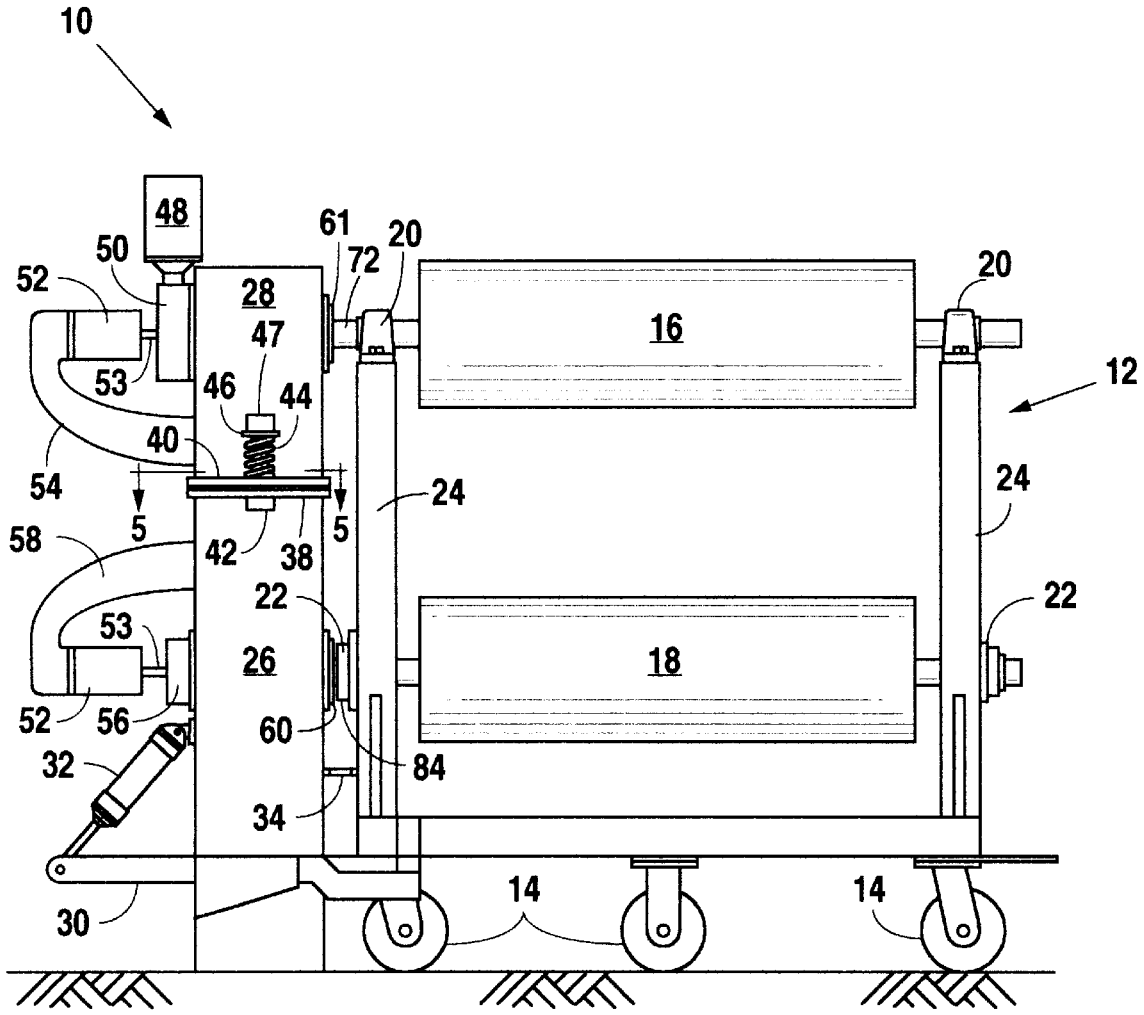
FIG. 1 is an elevational view of the automatic winding post embodying the present invention, showing a portable truck operationally connected to the winding post.

In an illustrative preferred embodiment of the present invention, as shown in FIG. 1, an automatic winding post 10 is arranged to receive and operate take-up and interleaf separator feed rolls on a portable truck 12 used in tire manufacturing operations. In the illustrated embodiment, the automatic winding post 10 is adapted to receive the portable truck 12 mounted on a plurality of wheels or castors 14 which facilitate movement of the truck 12 between processing stations. The winding post 10 also rotates, or controls the rotation of, supply and take-up rolls carried on the truck. More specifically, an upper roll 16 and a lower roll 18 are rotatably mounted on the truck 12. The upper roll 16 is mounted a square end shaft 72 rotatably supported in a pair of pillow blocks 20, and the lower roll 18 is mounted on a square end shaft 84 rotatably supported in a pair of flange bearings 22, all disposed on a pair of vertical members 24 attached to the base of the portable truck 12.

In the illustrated embodiment, the upper roll 16 is adapted to take-up a sheet, or ply of rubber from a ply processing station, and the lower roll 18 is adapted to provide a supply of fabric which serves as an interleaf or separator between adjacent layers of the sheet ply wound on the top roll 16. If desired, the functional operation of the upper and lower rolls could be reversed, or adapted for other uses.

In the illustrated preferred embodiment, the automatic winding post 10 is separated into two sections, a lower section 26 that is anchored to a floor at a pre-designated position, and an upper section 28 that, as described below in greater detail, has limited lateral movement capability with respect to the lower section 26. In an illustrative example, the upper and lower sections, or portions 26, 28 of the automatic winding post 10 are formed of 12"×12" steel tubing.

The lower section 26 of the automatic winding post 10 includes a means for drawing the truck 12 toward the post 10 and maintaining the truck 12 in fixed relationship with respect to the lower section 26 of the winding post 10. More specifically, the means includes a pair of horizontally moveable locking arms 30, one of which is visible in FIG. 1, are reciprocable in a horizontal direction and have a distal end adapted to engage a predetermined feature of the truck 12, such as the outside of the support member of a respective one of the pair of wheels 14 closest to the post 10. Each of the locking arms 30 also have an opposite, or proximal, end that is pivotally attached to an extendable cylinder 32. A central portion of the locking arms 30 have a slot adapted to receive a guide dowel attached to the lower section 26 of the automatic winding post 10. When positioning the truck at the automatic winding post 10, the moveable end of the cylinder 32 can be retracted to extend the locking arm 30 to a position spaced from the lower section 26 of the post 10. The truck 12 is placed in an approximately aligned position with respect to the winding post 10, whereat the extended distal end of the locking arms 30 will engage the supporting structure of the most proximal wheels 14 of the truck 12. The locking arm 30 is then retracted, drawing the truck 12 toward the post 10, by extending the moveable end of the cylinder 32, until the closest vertical member 24 of the truck 12 is brought into contact with an adjustable stop 34 mounted on the post 10. Thus, the truck 12 is generally laterally aligned with the lower section 26 of the post 10, is spaced at a predetermined position from the post 10, and is maintained at that aligned and spaced position during material take-up or other operations.

Figure 5:
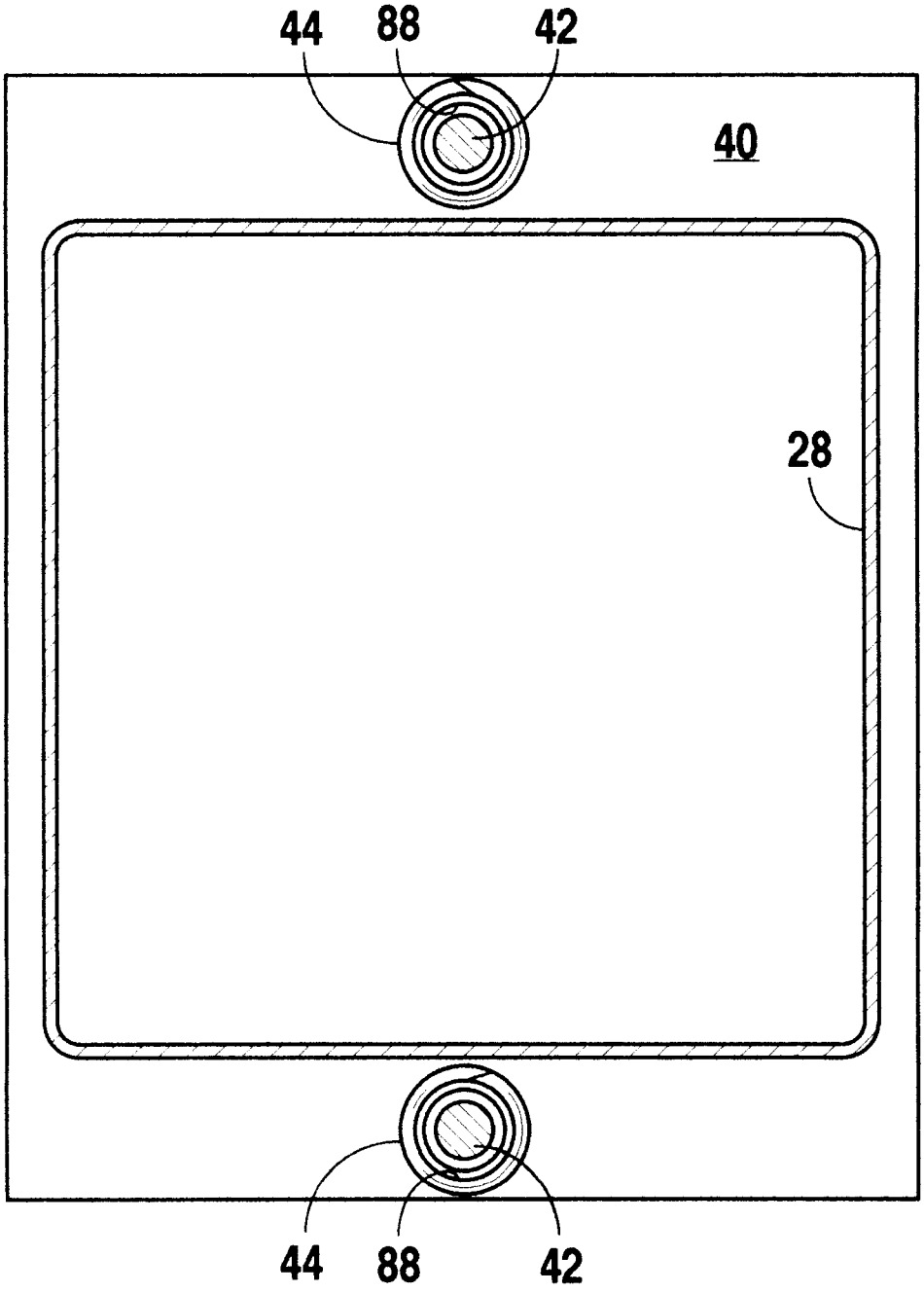
FIG. 5 is a sectional view of the automatic winding post embodying the present invention taken through the line 5—5 of FIG. 1.

The upper section 28 of the automatic winding post 10 is laterally moveable, in a somewhat restricted fashion, with respect to the lower section 26 of the automatic winding post 10. In the illustrated embodiment, a first flange, or cover, 38 having a somewhat greater surface area than the cross-sectional area of the lower section 26 of the post 10, e.g., a 12"×14" rectangular plate, is welded across the upper end of the lower section 26 of the post 10. In similar fashion, a cover plate, or second flange, 40 having a somewhat greater surface area than the cross-sectional area of the upper section 28 of the post 10, desirably having the same size and shape as the first flange 38, is welded to the bottom of the upper section 28. A pair of biased members, or dowel pins 42 extend through opposite sides of the first flange 38 attached to the lower section 26 of the post 10 and through enlarged holes or laterally oriented slots 88, as shown in FIG. 5, provided on opposite sides of the second flange 40 attached to the lower end of the upper section 28 of the post 10. A spring 44 on each of the dowel pins 42 is positioned on the respective pin 42, above the second flange 40, and is urged into biased contact with the respective second flange 40 by a washer 46 and a nut 47 that is secured to the upper end of the dowel 42. Thus, the first flange 38 attached to the lower section 26 of the post 10 and the second flange 40 attached to the upper section 28 of the post 10, are maintained in biased contact with each other by the force of the springs 44 but are free to move laterally within the limits of the enlarged holes or slots provided in the upper cover plate 40.

A motor 48 is connected to a right angle gear box 50 which is mounted on the upper section 28 of the automatic winding post 10 to provide rotation of the upper roll 16. An extendable air cylinder 52 is mounted on an arm 54 attached to the upper section 28 of the winding post 10 and provides reciprocal motion to a shaft 53 to operate a second chuck 61 mounted in the upper section 28 of the post 10, as described below in greater detail. An air brake 56 is mounted on the lower section 28 of the automatic winding post 10 to provide controllable resistance to rotation of the lower roll 18, and assure tension in the fabric interleaf as it is drawn between the plies of the upper roll 16. Another air cylinder 52 is mounted on an arm 58 attached to the lower section 26 of the post 10 and provides reciprocal motion to an actuating shaft 53 to open and close the jaws of a first clutch 60 mounted in the lower section 26.

Figure 2:
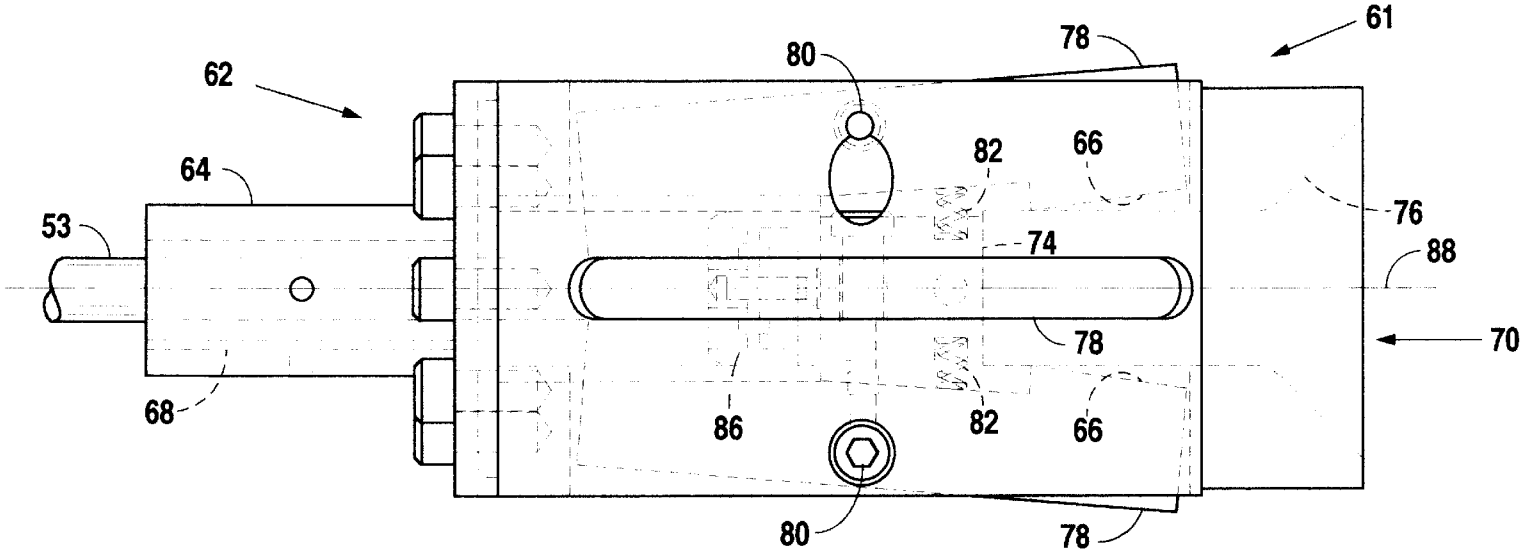
FIG. 2 is an elevational view of an automatically aligning four-jaw chuck embodying another aspect of the present invention.
Figure 4:
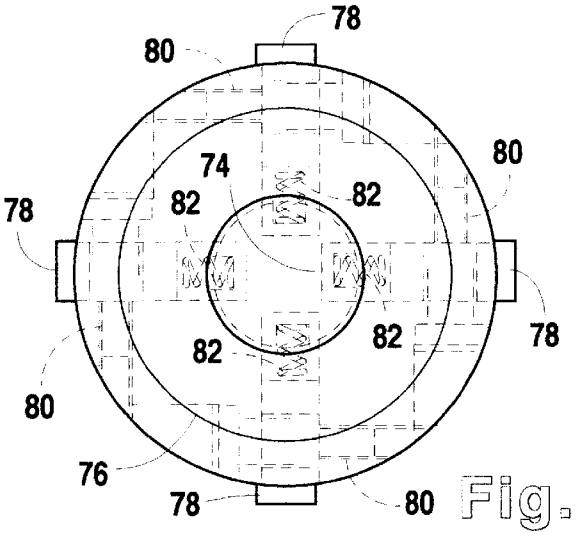
FIG. 4 is an end view of the roller attachment end of the four-jaw chuck shown in FIG. 2.
Figure 3:
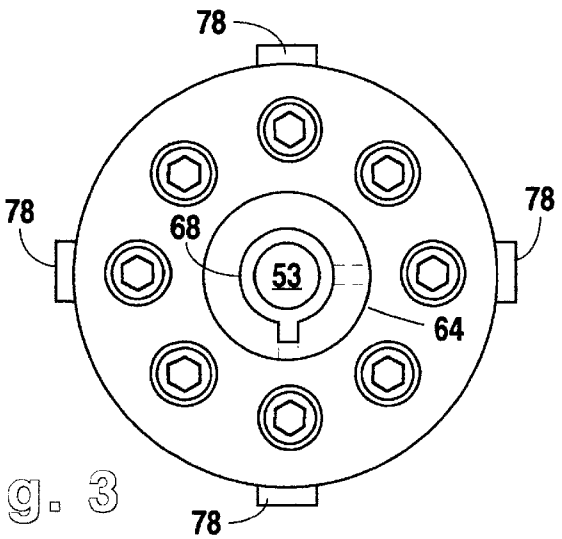
FIG. 3 is an end view of the drive attachment end of the four-jaw chuck shown in FIG. 2.

Turning now to FIGS. 2–4, separate first and a second four-jaw chucks 60, 61 are respectively mounted in lower and upper sections 26,28 of the post 10. The chucks 60, 61 have a proximal end 62 with an outwardly extending portion 64 respectively adapted for connection, respectively, to the right angle gear box 50 or the air brake 56. The respective actuating shafts 53, attached to the air cylinders 52 are carried within the outwardly extending portion 64 of the chucks 60, 61 in rotatable relationship with the chuck 60, 61 by a bushing 68 positioned around the actuating shaft 53.

The distal end 70 of the chucks 60, 61 have a conically-shaped opening 76, diverging inwardly from the open distal end, to provide a guide for a square end of the shaft 72 supporting the upper roll 16 or the square end of the shaft 84 which supports the lower roll 18. As the truck 12 is drawn toward the post 10 by the locking arm 30, the square end of the shaft 72 supporting the upper roll 16 engages the conical surface 76 at the distal end 70 of the second chuck 61 and incrementally moves the upper section 28 of the post 10 to align the second chuck 61 with the shaft 72. The end of the square shaft 72 is drawn into the chuck 61 to a position whereat the end of the shaft 72 is seated adjacent a bottom 74 of the opening 76.

The first chuck 60 mounted in the lower section 26 of the post 10 is positioned to receive the square end of the shaft 84 supporting the lower roll 18. When the truck 12 is drawn toward the post 10 by extension of the moveable end of the cylinder 32 attached to the end of the locking arm 30, the upper roll shaft 72 and the lower roll shaft 84 are drawn into the respective openings 76 at the distal end 70 of the chucks 60, 61. Since the upper section 28 of the post 10 is laterally moveable with respect to the lower section 26 of the post 10, contact of the shafts 72, 84 with the respective conical openings 76 of the chucks 60, 61, urges the chucks 60 into respective alignment with the shaft ends.

Each of the chucks 60, 61 have four jaws 78 that are pivotally mounted within the chuck 60, 61 by a respective pin 80, and are biased toward an open position, as indicated by the dotted outline of the jaws in FIG. 2, by a respective spring 82.

When the shafts 72, 84 are fully seated within the openings 76, the air cylinders 52 move the respective arms 53 to retract their respective ends. Each of the chucks 60, 61 have a bearing-mounted anvil, or plunger, 86 attached to the respective end of the shaft 53 of the air cylinders 52, so that the anvil is able to rotate with respect to the shaft 53. As indicated by the dashed outline of the jaws 78, each of the jaws 78 have a radially inwardly tapered surface that converges toward the center of chuck 61 as they approach the proximal end 62 of the chuck 61. As the anvil 86 is drawn toward the proximal end 62 of the chuck 61, by actuation of the air cylinder 52, the anvil bears against the tapered surface of each of the jaws 78 and forces each of the jaws 78 to pivot about the respective pin 80. The opposite, or clamping, end of the jaws are thus moved radially inwardly so that a gripping surface 66 of each jaw 78 comes into forced abutment with a planar surface of the respective square shaft 72, 84. Thus, each of the shafts 72, 84 are automatically rotated and aligned with a gripping surface within the respective chucks 60, 61.

After completion of the take-up, or other operation, the respective shafts 53 of the air cylinders 52 are extended and the respective jaws 78 of the chucks 60, 61 moved to a position away from contact with the respective shaft 72, 84 of the upper roll 16 and the lower roll 18 by the springs 82. Simultaneously, or immediately thereafter, the locking arm 30 is extended, and the truck 12 moved away from the post 10 and delivered to a subsequent processing station.

Thus, it can be readily seen that the automatic winding post 10, may be used as a docking post or station in many applications. The post 10 not only provides for positioning of a portable truck with respect to the post 10, but also is self-alignable with driven components on the truck 12. Also, it can be readily seen that the chucks 60, 61, having four jaws each of which is adapted to forcibly abut a respective flat surface of the end portion of a square shaft, is also self-aligning with respect to the shaft. Also, the upper and lower rolls 16, 18, and their respective gear box 50 or air brake 56 may be reversed in position, or other drive or brake arrangements substituted for those illustrated herein. These important characteristics and capabilities of the present invention significantly decrease the amount of difficult manual effort heretofore required to position and align a truck with respect to a drive post 10.

Although the present invention is described in terms of a preferred exemplary embodiment, with specific key arrangements of chucks and locking arms, those skilled in the art will recognize the changes and those arrangements may be made without departing from the spirit of the invention.

What I claim is:

1. A vertically disposed automatic winding post for receiving and rotatably driving lower and upper vertically spaced rolls mounted on a portable truck, said winding post comprising:

a lower section disposed at a fixed predetermined position and having a first rotatable chuck mounted thereon and a first means for controlling the rotation of said first rotatable chuck;

an upper section attached to said lower section in adjustable horizontal relationship with said lower section and having a second rotatable chuck mounted thereon and a second means for controlling the rotation of said second rotatable chuck; and a third means for drawing said truck toward said fixed lower section and maintaining said truck in a fixed relationship with respect to said lower section during rotation of said first and said second chucks, said third means being operatively mounted on said fixed-position lower section of the winding post.

2. An automatic winding post, as set forth in claim 1, wherein said upper section is horizontally adjustable in a lateral direction with respect to a longitudinal axis of said upper roll in response to drawing said truck toward said lower section by said third means and inserting a shaft end of said upper roll into said second rotatable chuck.

3. An automatic winding post, as set forth in claim 1, wherein said third means for drawing said truck toward said fixed lower section and maintaining said truck in a fixed relationship with respect to said lower section during rotation of said first and second chucks includes at least one locking arm slidably mounted on said fixed lower section of the winding post and having a distal end adapted to engage a predefined feature of said truck and is selectively movable in a substantially horizontal direction toward and away from said lower section and a proximal end spaced from the distal end, an extendable cylinder having a first end connected to said lower section of the winding post and a second end connected to said proximal end of the locking arm whereby said distal end of the locking arm is selectively moved toward and away from said lower section in response to respectively extending and retracting said extendable cylinder, and an adjustable stop mounted on said lower section, said adjustable stop being positioned to abut a predetermined feature of said truck when said locking arm draws said truck toward said lower section and said truck is spaced at a preselected distance from said lower section.

4. An automatic winding post, as set forth in claim 1, wherein said first means for controlling the rotation of said first rotatable chuck includes an air brake operatively connected to said first rotatable chuck.

5. An automatic winding post, as set forth in claim 1, wherein said second means for controlling the rotation of said second rotatable chuck includes a right angle gear operatively connected to said second chuck and a motor operatively connected to said right angle gear.

6. An automatic winding post, as set forth in claim 1, wherein said lower section has a first flange mounted on an upper end thereof and said upper section has a second flange mounted on a lower end thereof with a pair of laterally oriented slots provided in said second flange, and said winding post includes a pair of biased members each of which are mounted in said first flange and extend through a respective slot in said second flange whereby said biased members maintain the first and second flange in biased, laterally slidable contact with each other.

7. An automatic winding post, as set forth in claim 1, wherein said first rotatable chuck has four jaws and an actuating shaft connected to said first chuck which operatively moves said jaws between open and closed positions in response to respectively extending and retracting said actuating shaft, and said winding post includes an extendible cylinder attached to the lower section of said winding post and having a movable end attached to said actuating shaft connected to the first chuck.

8. An automatic winding post, as set forth in claim 1, wherein said second rotatable chuck has four jaws and an actuating shaft connected to said second chuck which operatively moves said jaws between open and closed positions in response to respectively extending and retracting said actuating shaft, and said winding post includes an extendible cylinder attached to the upper section of said winding post and having a movable end attached to said actuating shaft connected to the second chuck.

* * * * *